US008106279B1

(12) United States Patent
Chang

(10) Patent No.: US 8,106,279 B1
(45) Date of Patent: Jan. 31, 2012

(54) MOISTURE DRYING APPARATUS FOR WIND MUSICAL INSTRUMENTS

(76) Inventor: Shun-Hwa Chang, Fremont, CA (US)

( * ) Notice: Subject to any disclaimer, the term of this patent is extended or adjusted under 35 U.S.C. 154(b) by 75 days.

(21) Appl. No.: 12/852,054

(22) Filed: Aug. 6, 2010

Related U.S. Application Data

(63) Continuation-in-part of application No. 12/488,820, filed on Jun. 22, 2009, now Pat. No. 7,795,522.

(51) Int. Cl.
*G10D 9/00* (2006.01)

(52) U.S. Cl. ..... 84/453

(58) Field of Classification Search ..... 84/453
See application file for complete search history.

(56) References Cited

U.S. PATENT DOCUMENTS

| | | | | | |
|---|---|---|---|---|---|
| 1,421,529 | A | * | 7/1922 | Ross | 15/160 |
| 1,730,785 | A | * | 10/1929 | Romao | 15/211 |
| 2,759,714 | A | | 8/1956 | Ayup | |
| 3,488,790 | A | * | 1/1970 | Fusao | 15/118 |
| 3,739,420 | A | * | 6/1973 | Kafkis | 15/211 |
| 4,114,504 | A | * | 9/1978 | Koregelos | 84/453 |
| 4,768,293 | A | * | 9/1988 | Kaffka | 34/104 |
| 4,967,060 | A | * | 10/1990 | Lomeli | 392/384 |
| 5,003,707 | A | * | 4/1991 | Chu | 34/104 |
| 5,060,336 | A | * | 10/1991 | LaLonde | 15/104.095 |
| 5,179,790 | A | * | 1/1993 | Poulos | 34/104 |
| 5,212,332 | A | * | 5/1993 | Gigliotti | 84/453 |
| 5,222,308 | A | * | 6/1993 | Barker et al. | 34/104 |
| 5,289,642 | A | * | 3/1994 | Sloan | 34/104 |
| 5,555,588 | A | * | 9/1996 | Viesehon | 15/104.16 |
| 5,570,515 | A | * | 11/1996 | Schulte | 34/104 |
| 5,819,433 | A | * | 10/1998 | Crooks | 34/104 |
| 5,839,204 | A | * | 11/1998 | Cinque et al. | 34/97 |
| 5,930,913 | A | * | 8/1999 | Liao et al. | 34/104 |
| 6,005,179 | A | * | 12/1999 | Currie | 84/453 |
| 6,732,449 | B2 | | 5/2004 | Evanyk | |
| 7,795,522 | B1 | * | 9/2010 | Chang | 84/453 |
| 7,941,888 | B2 | * | 5/2011 | Bertoldi | 15/88 |
| 2009/0271945 | A1 | | 11/2009 | Ludwigson | |

OTHER PUBLICATIONS

USPTO—Office Action Mailed on Jul. 2, 2010 (U.S. Appl. No. 12/488,820).
Response to the Jul. 2, 2010 Office Action (U.S. Appl. No. 12/488,820)—Jul. 6, 2010.
Correction to Response to the Jul. 2, 2010 Office Action (U.S. Appl. No. 12/488,820)—Jul. 9, 2010.
USPTO—Notice of Allowance Mailed on Aug. 6, 2010 (U.S. Appl. No. 12/488,820).

* cited by examiner

*Primary Examiner* — Elvin G Enad
*Assistant Examiner* — Robert W Horn
(74) *Attorney, Agent, or Firm* — Roger H. Chu

(57) ABSTRACT

Wind musical instrument moisture drying devices are disclosed. According to one embodiment, the drying device comprises a fan unit containing a fan mounted on a motor housed in an enclosure having opposite first and second ends, the fan is located within the enclosure near the first end and is configured for drawing air flow from the second end toward the first end while in operation, an electric energy source coupled to the fan unit via a cable, and an adjustable adapter radially coupled to outer perimeter of the enclosure of the fan unit, the adjustable adapter is so configured to be fit over an opening of the wind musical instrument's tubular body, where moistures accumulated inside the wind musical instrument are desired to be dried by the moisture drying device, which is deployed into the tubular body by inserting the fan unit into the opening.

17 Claims, 11 Drawing Sheets

MOISTURE DRYING APPARATUS FOR WIND MUSICAL INSTRUMENTS

CROSS-REFERENCE TO RELATED APPLICATION

This application is a continuation-in-part of a co-pending U.S. patent application Ser. No. 12/488,820 for the same title, filed Jun. 22, 2009.

FIELD OF THE INVENTION

The present invention generally relates to musical instrument accessories, and more particularly to a moisture drying apparatus for wind musical instruments, for example, trumpet, saxophone, horn, French horn, cornet, flute, tuba, clarinet, trombone, etc.

BACKGROUND OF THE INVENTION

A wind musical instrument contains some type of resonator (usually a tube), in which a column of air is set into vibration by the player blowing into (or over) a mouthpiece set at the end of the resonator. The pitch of the vibration is determined by the length of the tube and by manual modifications of the effective length of the vibrating column of air. In the case of some wind musical instruments, sound is produced by blowing through a reed; others require buzzing into a metal mouthpiece.

When a player plays a wind musical instrument, some of the breaths are condensed inside the instrument. As a result, moistures are formed and accumulated in the interior of the musical instrument (e.g., U-shape passage, tone hole, etc.) each time after playing, thereby causing the inside surface of the wind musical instrument to rust or corrode over time. To overcome this problem, one of the prior art approaches is to use a swab to remove the accumulated moistures. However, using a swab has a number of problems: 1) the swab can sometime jam within the body of the instrument, 2) the swab cannot completely remove the moisture and 3) the swab cannot reach small passages and/or U-shape tubes in some of the wind musical instruments.

Further problem of accumulated moistures is a result of normal practice of storing wind musical instruments, which are generally put in a carrying case after playing. Since the carrying case is a closed environment, accumulated moistures are trapped therein thereby worsening the rusting problem due to longer time to dry up.

Therefore, it would be desirable to have a moisture drying device that can overcome the problems, drawbacks and shortcomings of the prior art approaches. Especially a moisture drying device can be deployed inside a carrying case of wind musical instrument.

SUMMARY OF THE INVENTION

This section is for the purpose of summarizing some aspects of the present invention and to briefly introduce some preferred embodiments. Simplifications or omissions in this section as well as in the abstract and the title herein may be made to avoid obscuring the purpose of the section. Such simplifications or omissions are not intended to limit the scope of the present invention.

Moisture drying devices for wind musical instruments are disclosed. According to an exemplary embodiment of the present invention, a moisture drying device comprises a core member, a base member and an optional flexible adaptor member. The core member includes a hollow enclosure, a fan, an electric energy source (e.g., battery) and a fan operations control unit. The fan is mounted on top of the hollow enclosure, while the electric energy source and the fan operations control unit are housed inside. The base member contains at least one extrusion element located on the surface of the hollow enclosure substantially near the bottom end. The extrusion element is configured to be orientated radially outward from the centerline of the hollow enclosure. The core member and the base member can be fixedly connected to each other, or connected via a connecting means (e.g., screwed connector, snap-on connection, etc.).

The optional flexible adaptor member is configured for adapting over the base member such that it can be flexibly adjusted or reshaped to be snuggled with inside surface of a wind musical instrument having a flared opening (e.g., a bell of the wind musical instrument).

The moisture drying device when assembled together is placed inside of the wind musical instrument (e.g. a bell of a trumpet, or a tubular body of a flute, etc.). When the fan is turned on, airflow is forced through inner passage of the wind musical instrument thereby drying the accumulated moistures. As a result, the moisture drying apparatus provides a function that overcomes the drawbacks, shortcomings and problems of the prior art approaches. In order to enable air circulation, one or more air inlets are configured on the hollow enclosure. An optional compartment for storing moisture absorbing agent (e.g., desiccant) is configured between the fan and the air inlets.

The fan operations control unit can be made of a print circuit board having a temperature sensor, a timer and an energy source management circuitry configured thereon. The timer is configured for controlling the fan to be on for a predetermined period of time. The temperature sensor is configured to measure the temperature of the fan motor. When the fan motor temperature has exceeded a critical temperature, the fan operations control unit can issue a command to turn the fan off. The energy source management circuitry is configured to manage the electric energy source including optional recharging of the electric energy source if so configured (i.e., rechargeable battery).

The core member is so dimensioned that it can be fit inside of a tubular body of a particular type of wind musical instrument to be dried. The base member is so dimensioned that it can be fit over the opening the tubular body to allow the assembled moisture drying device to be stabilized when deployed.

In another embodiment, the flexible adaptor member comprises at least three struts extended radially outward from the base member's center in an axisymmetrical manner. And each of the at least three struts comprises a means for adjusting said each strut's length to enable the moisture drying device to be snuggled with the inside surface of the flared opening of a wind musical instrument (e.g., the bell of trumpet).

In yet another embodiment, the moisture drying device for wind musical instruments comprises a fan unit containing a fan mounted on a motor housed in an enclosure having opposite first and second ends, the fan is located within the enclosure near the first end and is configured for drawing air flow from the second end toward the first end while in operation, an electric energy source coupled to the fan unit via a cable, and an adjustable adapter radially coupled to outer perimeter of the enclosure of the fan unit, the adjustable adapter is so configured to be fit over an opening of the wind musical instrument's tubular body, where moistures accumulated inside the wind musical instrument are desired to be dried by the moisture drying device, which is deployed into the tubular body by inserting the fan unit into the opening. The energy source can be in forms of a power and control unit that can be stored in a cavity space inside of a wind musical instrument's carrying case.

Other objects, features, and advantages of the present invention will become apparent upon examining the following detailed description of an embodiment thereof, taken in conjunction with the attached drawings.

BRIEF DESCRIPTION OF THE DRAWINGS

These and other features, aspects, and advantages of the present invention will be better understood with regard to the following description, appended claims, and accompanying drawings as follows:

DETAILED DESCRIPTION

In the following description, numerous specific details are set forth in order to provide a thorough understanding of the present invention. However, it will become obvious to those skilled in the art that the present invention may be practiced without these specific details. The descriptions and representations herein are the common means used by those experienced or skilled in the art to most effectively convey the substance of their work to others skilled in the art.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments mutually exclusive of other embodiments. Used herein, the terms "top" and "bottom" are intended to provide relative positions for the purposes of description, and are not intended to designate an absolute frame of reference. Further, the order of blocks in diagrams representing one or more embodiments of the invention do not inherently indicate any particular order nor imply any limitations in the invention.

Embodiments of the present invention are discussed herein with reference to FIGS. 1A-8. However, those skilled in the art will readily understand and appreciate that the detailed descriptions given herein with respect to these figures is for explanatory purposes as the invention extends beyond these limited embodiments.

Figure 1A:
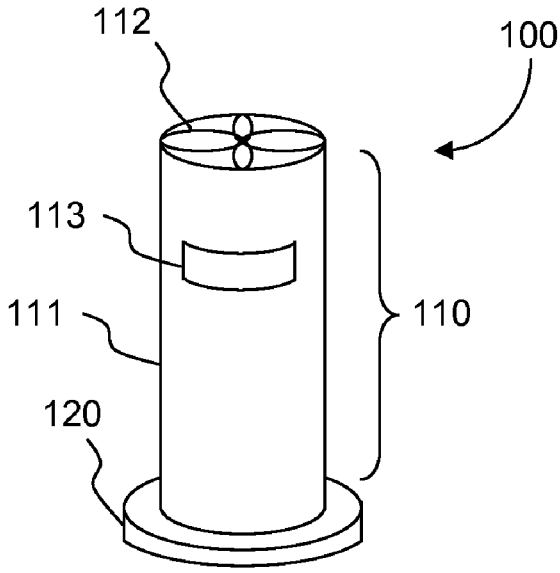
FIG. 1A is a perspective view depicting an exemplary moisture drying device having a core member and base member, according to an embodiment of the present invention.
Figure 1B:
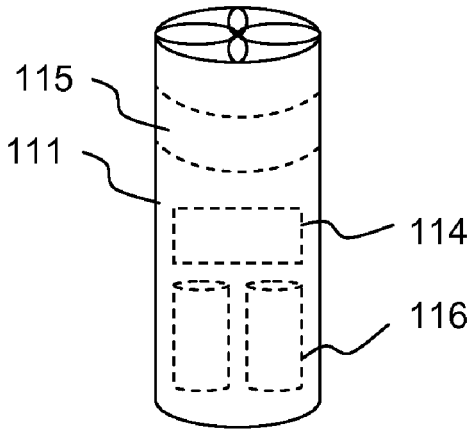
FIG. 1B is a perspective view showing salient components inside the core member of the moisture drying device of FIG. 1A.

Referring now to the drawings, in which like numerals refer to like parts throughout the several views. FIG. 1A is a perspective view showing an exemplary moisture drying device 100, according to an embodiment of the present invention. The moisture drying device 100 comprises a core member 110 and a base member 120 coupled together at the bottom end of the core member 110. The core member 110 and base member 120 can be fixedly connected to each other as shown herein.

The core member 110 includes a hollow enclosure 111 with a fan 112 mounted on the top end of the core member 110. The fan 112 can be a miniature electric fan used inside a notebook computer. Since the core member 110 and the hollow enclosure 111 share same orientation, the top and bottom ends of the core member 110 are interchangeably referred to as the top and bottom ends of the hollow enclosure 111. At least one air inlet 113 is configured on the hollow enclosure 111 to allow air inflow through the fan 112. Housed inside the hollow enclosure 111 shown in FIG. 1B, there are a fan operations control unit 114, an electric energy source 116 (i.e., at least one battery), and an optional compartment 115 for storing moisture absorbing agent (e.g., desiccant).

Figure 2A:
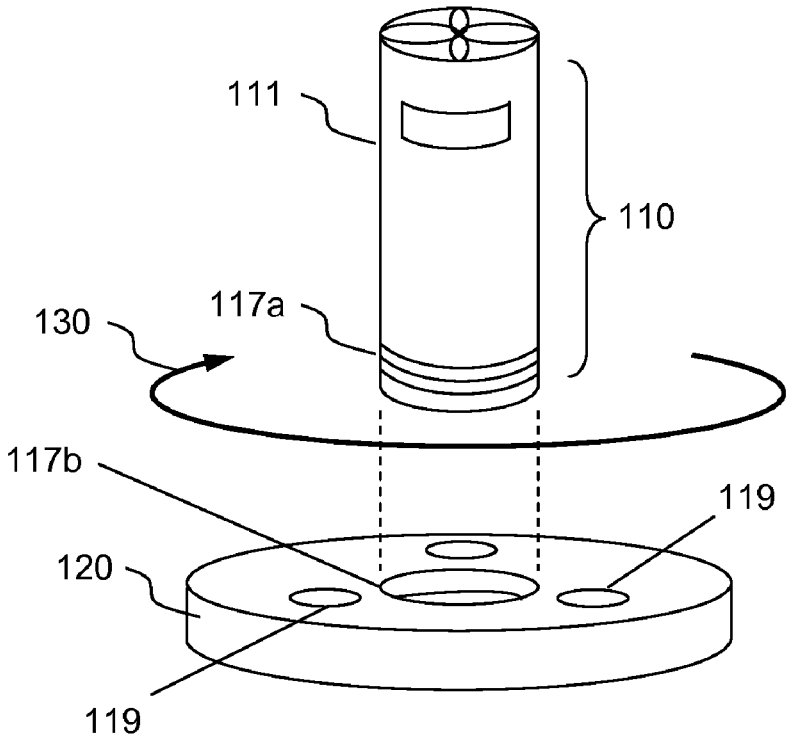
FIG. 2A is an exploded perspective view showing the moisture drying device of FIG. 1A.
Figure 2B:
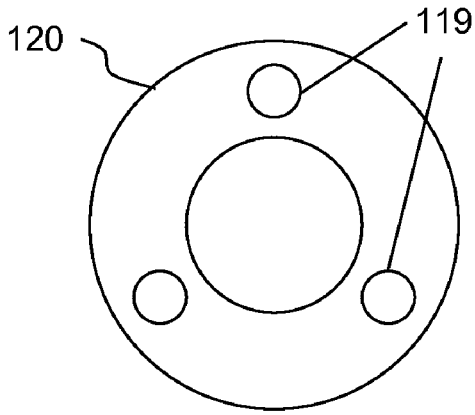
FIG. 2B is a plan view showing the base member of the moisture drying device of FIG. 1A.

Shown in FIGS. 2A-2B, the base member 120 couples to the hollow enclosure 111 via a connecting means. One exemplary connecting means is achieved as follows: the base member 120 is configured to have a receptacle 117*b* substantially near the center. The receptacle 117*b* is a circular hole with threaded grooves while matching threads 117*a* are configured on the outer surface of the hollow enclosure 111 near the bottom end. The base member 120 and the core member 110 are connected through twist motions in a direction shown as arrow 130. It is noted that other equivalent connecting means can be used, for example, snap-on connection. The base member 120 further comprises one or more holes 119 for allowing air to flow through the moisture drying device 100 when deployed inside a wind musical instrument shown in FIGS. 4A-4B. Another function of the holes 119 is to allow user to hold, deploy or remove the moisture drying device 100 with user's fingers.

Figure 3A:
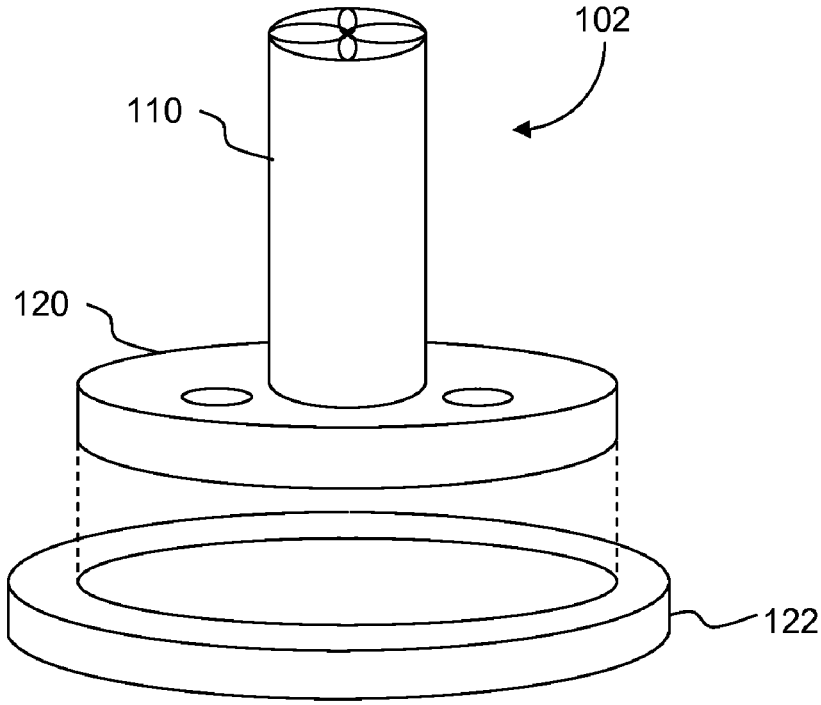
FIG. 3A is an exploded perspective view showing a flexible adaptor member coupling to the moisture drying device of FIG. 1A.
Figure 3B:
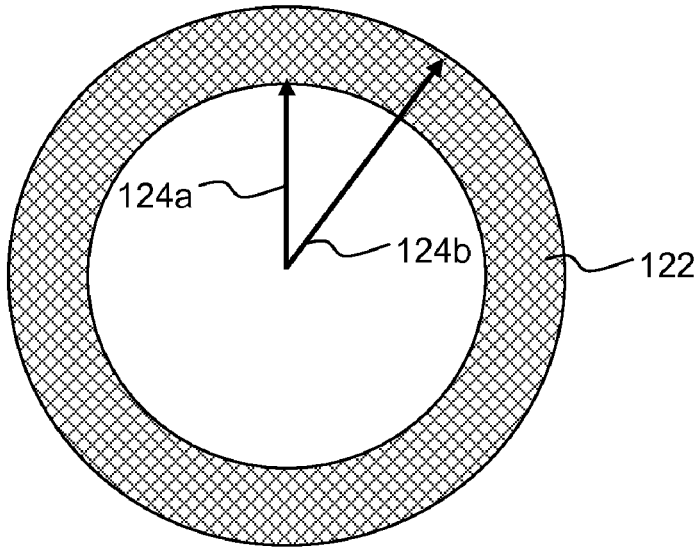
FIG. 3B is a plan view showing the flexible adaptor member of FIG. 3A.

An alternative embodiment is shown in FIGS. 3A-3B. The moisture drying device 102 comprises a flexible adaptor member 122 in addition to core member 110 and base member 120. The flexible adaptor member 122 is configured to adapt to the perimeter of the base member 120. Further, the flexible adaptor member 122 is made of soft material (e.g., foam, rubber, etc.) that can be reshaped to enable the assembled moisture drying device 102 be snuggled with the inside surface of the flared opening of a wind musical instrument (e.g., a bell 152 of trumpet shown in FIG. 4B). One of the advantages of using a flexible adaptor member 122 is to allow the core member 110 to be used in various sizes of flared openings, for example, saxophone and trumpet.

In one embodiment, the flexible adaptor member 122 is a doughnut-shaped structure having inner and outer radii 124*a-b* shown in FIG. 3B. The inner radius is so dimensioned that the perimeter of the base element 120 can be adapted therein, while the outer radius is so dimensioned to be snuggled with the inside surface of the wind musical instrument' flared opening.

Figure 4A:
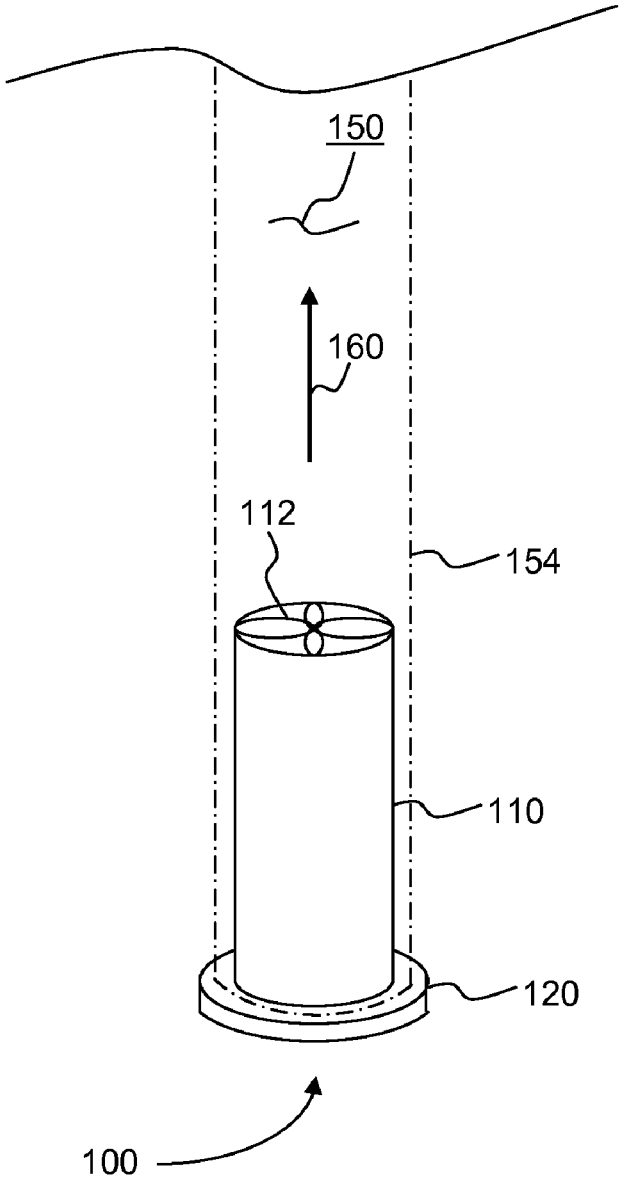
FIG. 4A is a perspective view showing an exemplary moisture drying device deployed in a tubular body of a wind musical instrument, according to an embodiment of the present invention.

FIG. 4A is a perspective view showing an exemplary moisture drying device 100 deployed in a tubular body 154 of a wind musical instrument, according to an embodiment of the present invention. The moisture drying device 100 is deployed by inserting the core member 110 inside the tubular body 154 of a wind musical instrument (e.g., flute) with the fan 112 facing inward. The base member 120 is configured to be fit over the opening of the tubular body 154, for example, with a clamp-on or snap-on adaptor. The base member 120 is also configured as a stabilizer to prevent the moisture drying device 100 to move freely when deployed, and the base member 120 is so dimensioned to fit various sizes of openings. It is noted that the fan 112 can be facing outward to accomplish the drying function by sucking the moistures out of the interior of a musical instrument.

Figure 4B:
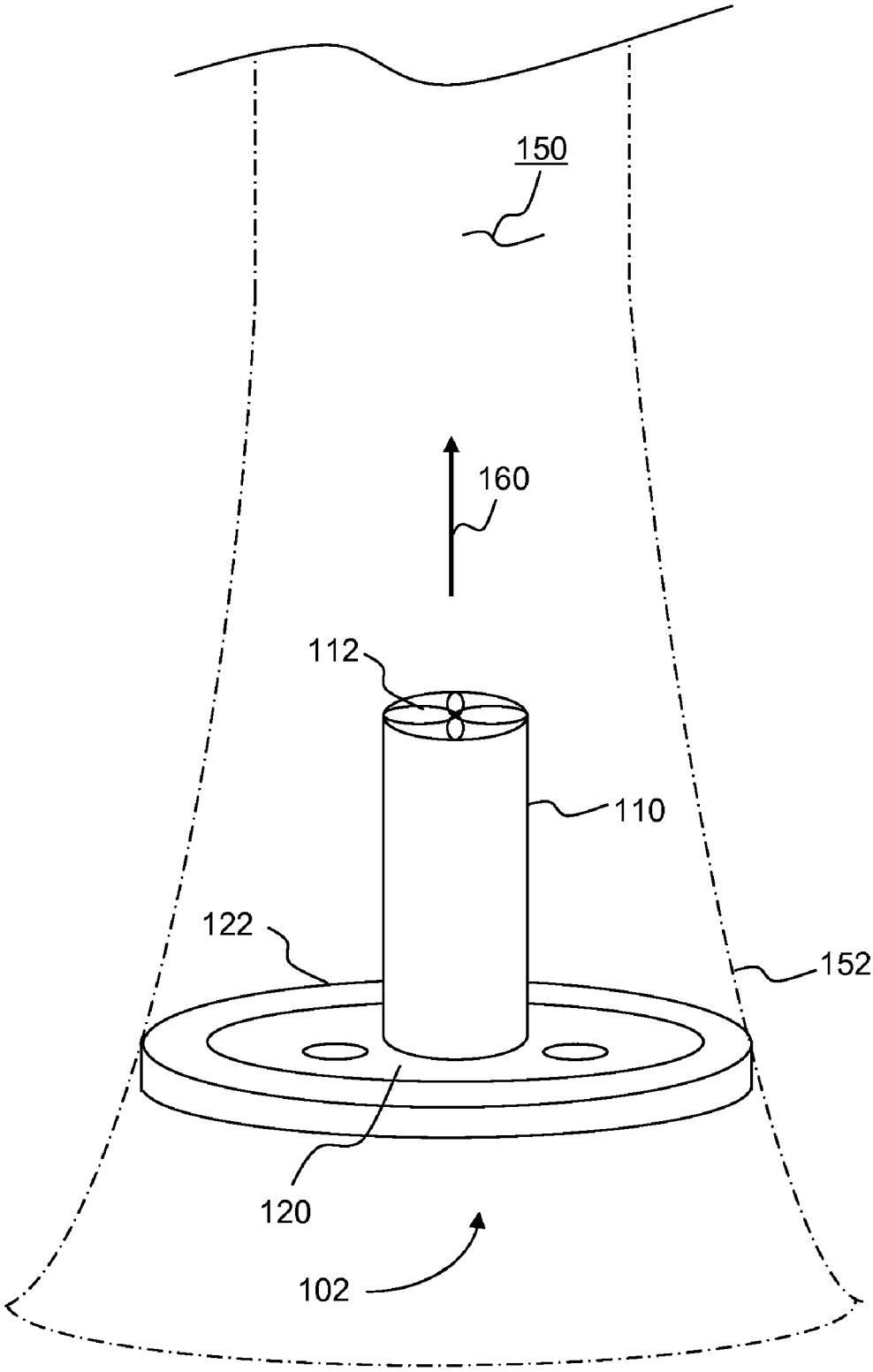
FIG. 4B is a perspective view showing an exemplary moisture drying device deployed in a flared opening of a wind musical instrument, according to another embodiment of the present invention.

Referring now to FIG. 4B, it is a perspective view showing another exemplary moisture drying device 102 deployed in a flared opening 152 of a wind musical instrument (e.g., trumpet), according to another embodiment of the present invention. In order to provide stability of the moisture drying device 102, the base member 120 comprises substantially similar rigidity comparing to the hollow enclosure 111, for example, keeping the moisture drying device 102 substantially in the middle of the flared opening 152. The flexible adaptor member 122 is configured to be flexibly reshaped for a snuggled fit.

When the fan 112 is turned on, the airflow is forced through interior 150 of the wind musical instrument in the direction 160 thereby drying the moistures accumulated in the interior during prior use. It is noted that dimensions of the core member 110, the base member 120, the flexible adaptor member 122 and other elements are not to scale in all figures. The dimensions can be larger or smaller depending upon implementation of the present invention.

Figure 5:
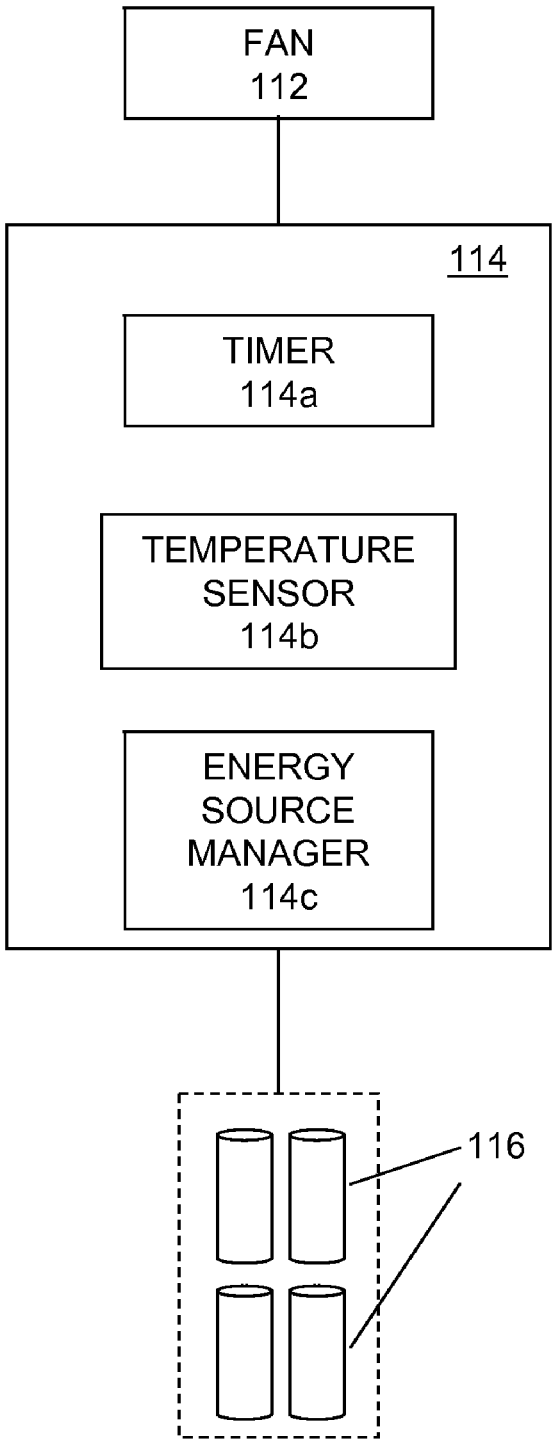
FIG. 5 is a function diagram showing salient components of an exemplary fan operations control unit in operation with a fan and an electric energy source in accordance with one embodiment of the present invention.

FIG. 5 is a function diagram showing salient components of an exemplary fan operations control unit 114 in operation with a fan 112 and an electric energy source 116 in accordance with one embodiment of the present invention. The fan operations control unit 114 can be made of a printed circuit board with a timer 114*a*, a temperature sensor 114*b* and an energy source manager 114*c* configured thereon. The timer 114*a* is configured for providing control to keep the fan 112 on for a predetermined period of time. The temperature sensor 114*b* is configured for detecting the temperature of the fan's motor. When the temperature of the fan's motor exceeds a critical temperature, the fan operations control unit 114 can issue a command to turn off the fan to prevent overheating of the motor. The energy source manager 114*c* is configured to regulate the electric energy source 116 being used by the fan 112. In one embodiment, the energy source manager 114*c* can also control a recharging operation of the electric energy source (e.g., rechargeable battery).

Figure 6A:
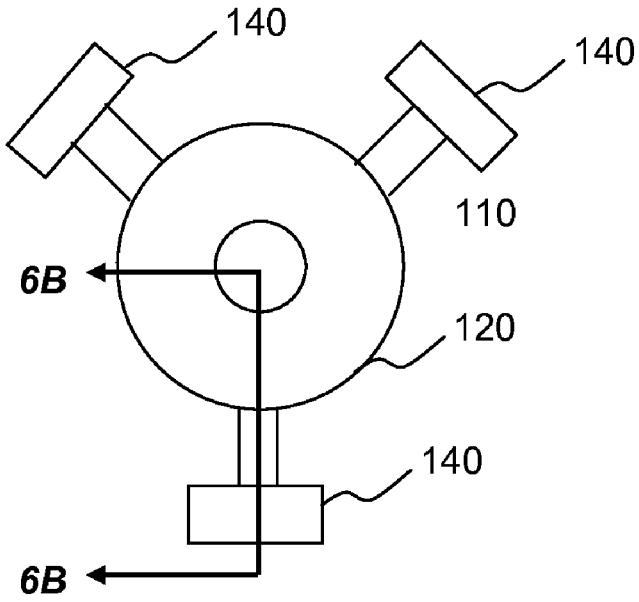
FIGS. 6A-6B are diagrams collectively showing an alternative flexible adaptor element of an exemplary moisture drying device in accordance with one embodiment of the present invention.
Figure 6B:
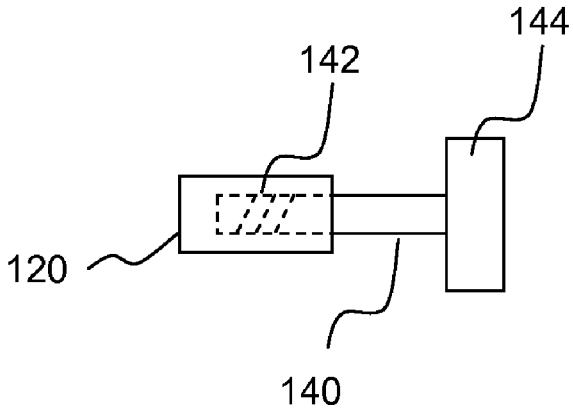

Alternative flexible adaptor element in forms of adjustable struts 140 is shown in FIGS. 6A and 6B. At least three struts 140 extend radially outward from the center of the base member 120 in an axisymmetrical manner. Each of the struts 140 comprises a means for adjusting said each strut's length to enable the moisture drying device 100 to be snuggled with the inside surface of the wind musical instrument's flared opening. For example, threaded strut 142 can be used to lengthen or shorten the length of the strut shown in FIG. 6B. Outer end 144 of the strut 140 is made of soft material to ensure a snuggled fit between the inside surface of the wind musical instrument.

Figure 7A:
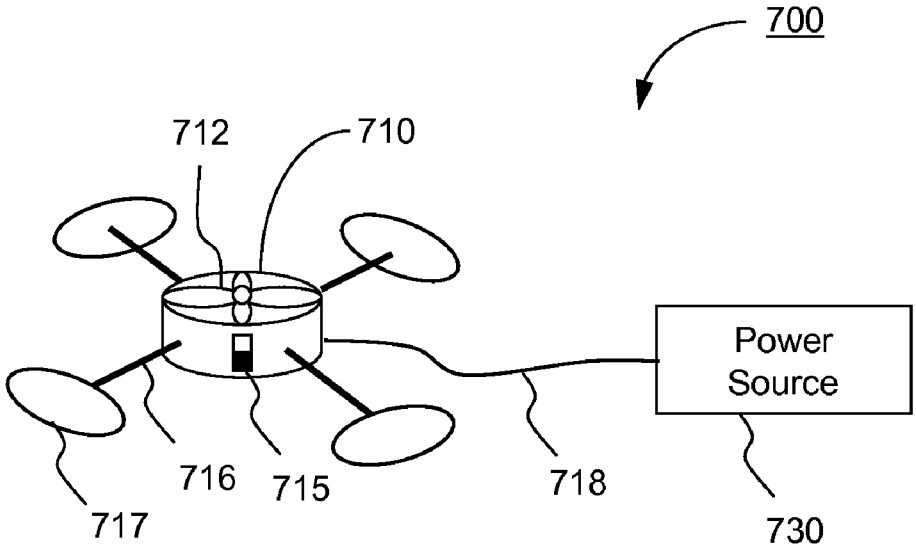
FIG. 7A is a diagram showing an exemplary moisture drying device, according to an embodiment of the present invention.

Referring now to FIG. 7A, it is shown an exemplary moisture drying device 700, according to another embodiment of the present invention. The moisture drying device 700 includes a fan unit 710, an electric energy source 730 and an adjustable adapter 716-717. The fan unit 710 and the electric energy source 730 are operatively coupled together via a cable 718. The adjustable adapter is radially adapted to the outer perimeter of the fan unit 710. Also configured on the fan unit 710 is a control 715 (e.g., a switch for turning the fan on or off). The control can also include a timer so that the fan unit 710 can be put in operation in a preset amount of time. Electric energy source 730 can be one or more batteries (disposable or rechargeable), a direct current (DC) electric power converted from wall outlet, or a DC electric power drawn from an automobile battery via well-known means (e.g., a receptacle inside the car).

Figure 7B:
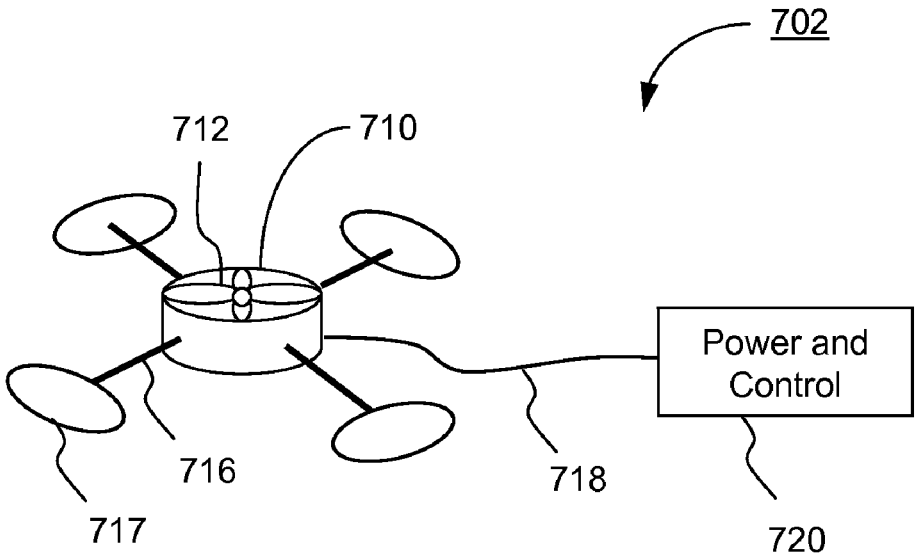
FIG. 7B is a diagram showing an alternative exemplary moisture drying device, according to another embodiment of the present invention.

According to another embodiment, an alternative moisture drying device 702 shown in FIG. 7B comprise a fan unit 710 without switch 715 and a separate power and control unit 720 connected by a cable 718.

Figure 7C:
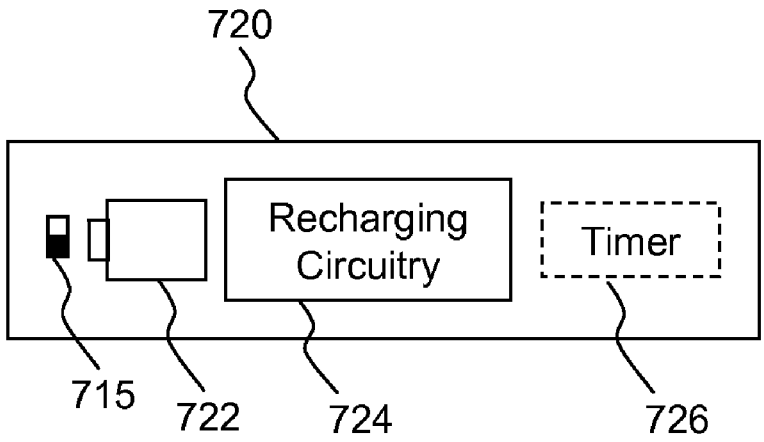
FIG. 7C is a diagram showing salient components of an exemplary power and control unit of the moisture drying device of FIG. 7B.

The power and control unit 720 shown in FIG. 7C is housed in a unit separated from the fan unit 720. The power and control unit 720 includes at least an energy source 722, a recharging circuitry 724, an optional timer 726 and an optional switch 715. The energy source 722 can be one or more batteries which can be recharged with well-known procedure, for example, an outside power source through the recharging circuitry 724. The timer 726 is configured for limiting amount of time the fan 712 is in operation (e.g., to prevent overheating). The power and control unit 720 is operatively connected to the fan unit 710 via a cable 718 (e.g., power cable). In one embodiment, cable 718 can be disconnected at either end. In another, cable 718 can be released at both ends. All components in the power and control unit 720 may be configured separately to make the design flexible.

Figure 7D:
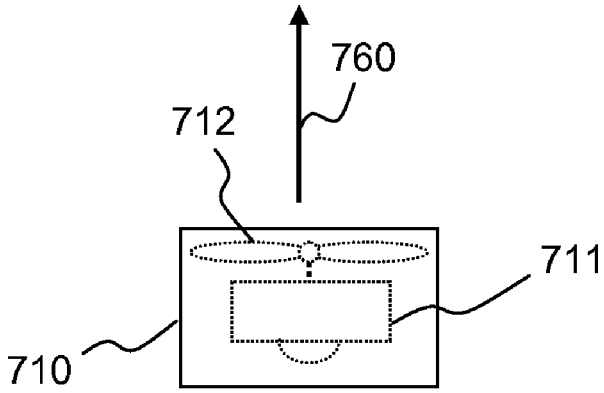
FIG. 7D is a side elevation view of the fan unit of the moisture drying device of FIG. 7B.

FIG. 7D is a side view showing the fan unit 710, which includes a fan 712 mounted on motor 711 housed in an enclosure having opposite first and second ends, (i.e., top and bottom ends shown in FIG. 7D). The fan 712 is located near the first end and configured for drawing air flow 760 from the second end to the first end while in operation. Exemplary fan unit can be found in a modern computer system as a cooling fan of electronic components.

Figure 7E:
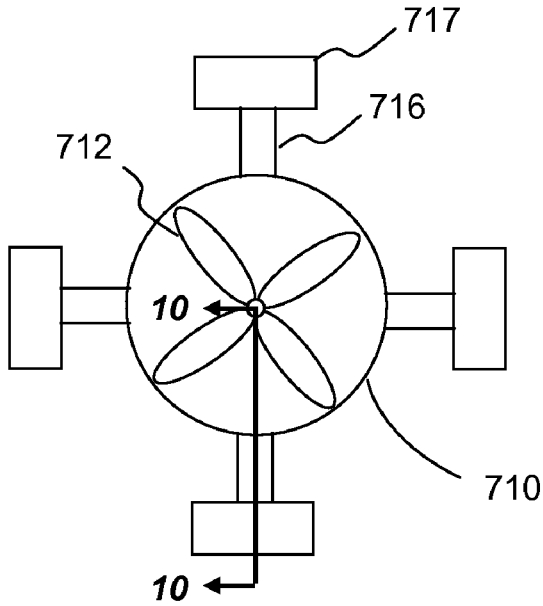
FIG. 7E is a top plan view of the fan unit of the moisture drying device of FIG. 7B.
Figure 7F:
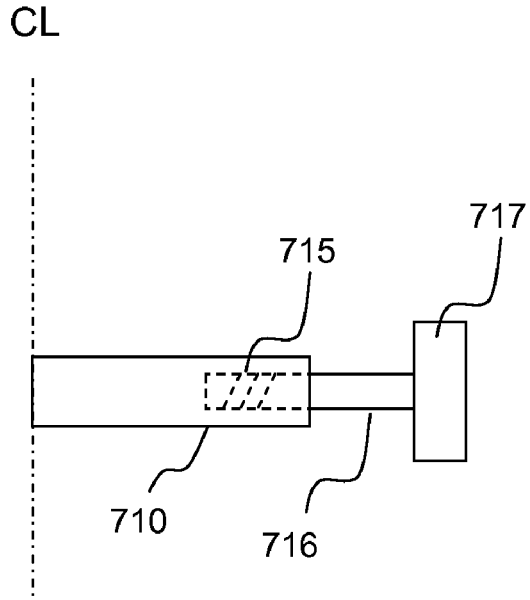
FIG. 7F is a cross-sectional view of the adjustable adapter of FIGS. 7A-7B.

A top plan view of the fan unit 710 including the adjustable adapter is shown in FIG. 7E. The adjustable adapter includes at least three struts (four shown in FIGS. 7A, 7B and 7E) radially coupled to the outer perimeter of the fan unit 710. In this embodiment, the strut comprises an adjustable rod 716 (e.g., length adjustable) and a pad 717. The adjustable rod 716 is configured to radially couple to the fan unit 710. For example, shown in FIG. 7F, a screw means 715 (drawn with an arbitrary scale) is used for adjusting the length of the adjustable rod 716 such that the pad 717 can be snuggled with inside surface of a musical instrument's flared opening. Pad 717 is generally made of soft material (e.g., foam, rubber, etc.) such that the pad 717 does not damage the inside surface of the musical instrument.

The adjustable adapter can also be made of an annulus or a ring that adapts to the outer perimeter of the fan unit 710 (e.g., similar to the adapter shown in FIGS. 3A-B). Moreover, the ring-type adjustable adapter can radially couple to another adjustable adapter as another outer ring.

Figure 8:
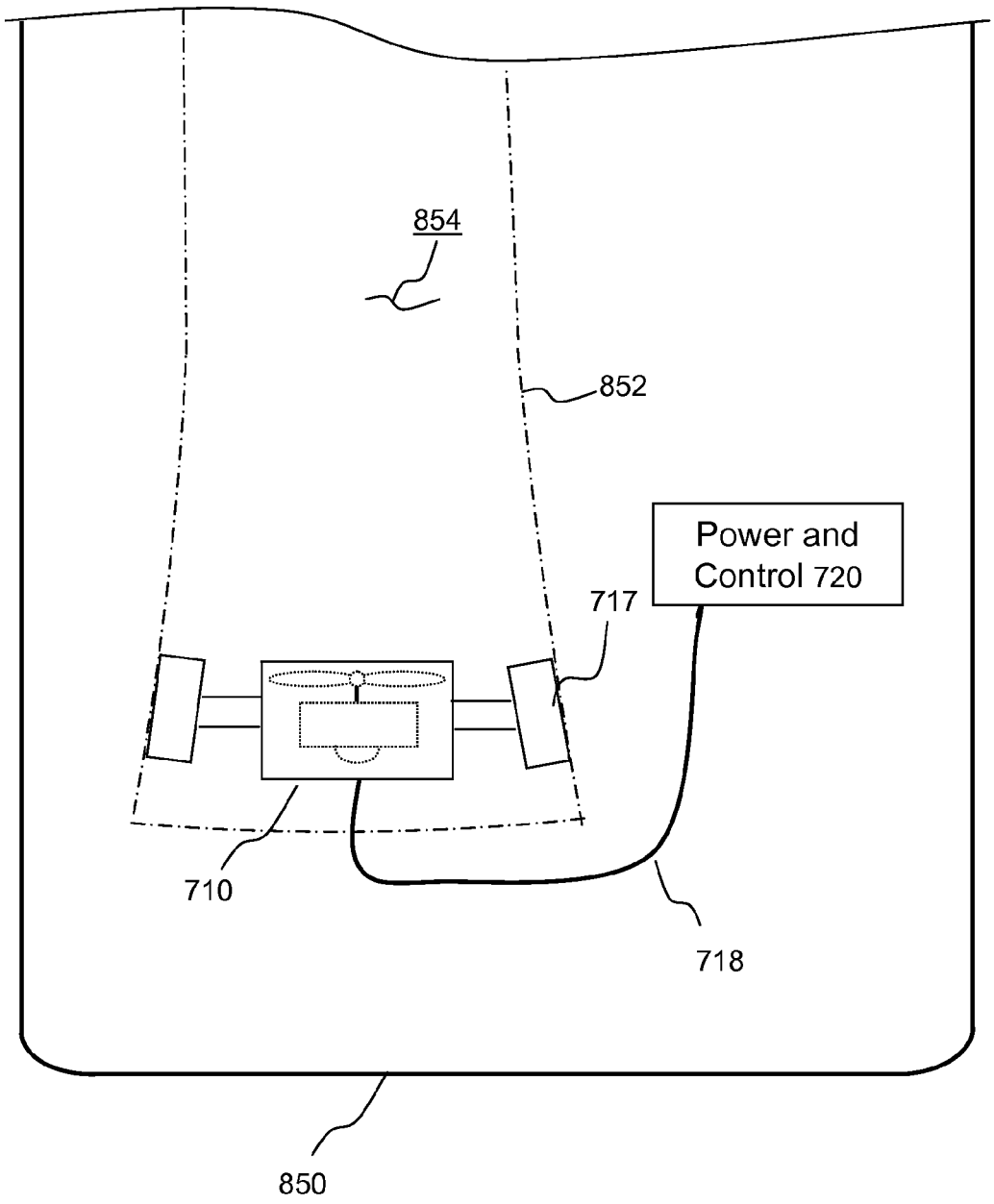
FIG. 8 is a diagram showing an exemplary deployed configuration of the moisture drying unit of FIGS. 7A-7B.

FIG. 8 shows an exemplary deployed configuration of the moisture drying device 705 of FIG. 7B. The fan unit 710 is deployed inside the flared opening 852 of a musical instrument, which is stored in a carrying case 850 (only partial case shown). The fan unit 710 is connected to a power and control unit 720 via a cable 718. The power and control unit 720 is intended to be placed in a cavity within the carrying case 850. Moistures accumulated in the interior 854 of the wind musical instrument are to be dried by the moisture drying device 700.

It is noted that the configuration shown in FIG. 8 can be changed, for example, the power and control unit 720 can be replaced with an electric energy source 730, while a switch 715 can be configured on the fan unit 710.

Although the present invention has been described with reference to specific embodiments thereof, these embodiments are merely illustrative, and not restrictive of, the present invention. Various modifications or changes to the specifically disclosed exemplary embodiments will be suggested to persons skilled in the art. For example, whereas the hollow enclosure has been shown and described as being a circular cylindrical shape. Other shapes of cylinder can be used instead, for example, a triangle, square, or other polygons. Additionally, the core member has been shown as an elongated cylindrical member, other shapes can be used to provide equivalent functionality. Further, the shape of the base member has been shown and described as a doughnut-shaped structure. Other shapes of closed polygon can provide the equivalent function of providing a stable base of the column member. Furthermore, a few exemplary batteries have been shown as the electric energy source, other number of batteries can be used for other configurations or embodiments. Moreover, whereas the fan operations control unit has been shown and described as a printed circuit board. Other equivalent control units can be used instead, for example, an application specific integrated circuit. Finally, whereas the fan has been shown and described facing inward in the tubular body of a musical instrument for blowing outside air into the interior to dry the moisture accumulated inside. However, the fan can be facing outward for sucking the moisture out of the interior of the musical instrument to accomplish the drying function. In summary, the scope of the invention should not be restricted to the specific exemplary embodiments disclosed herein, and all modifications that are readily suggested to those of ordinary skill in the art should be included within the spirit and purview of this application and scope of the appended claims.

I claim:

1. A moisture drying device for removing moistures accumulated inside a wind musical instrument comprising:

a fan unit including a fan mounted on a motor housed in an enclosure having opposite first and second ends, the fan being located within the enclosure near the first end and being configured for drawing air flow from the second end toward the first end while in operation;

an electric energy source coupled to the fan unit via a cable; and an adjustable adapter radially coupled to outer perimeter of the enclosure of the fan unit, the adjustable adapter being so configured to be fit over an opening of the wind musical instrument's tubular body, whereby moistures accumulated inside the wind musical instrument are dried by the moisture drying device and the moisture drying device is deployed in the tubular body by inserting the fan unit into the opening.

2. The moisture drying device of claim 1, the fan unit is so dimensioned that it can be placed inside a tubular body of a particular type of wind musical instrument desired to be dried.

3. The moisture drying device of claim 1, the fan unit further comprises a switch for controlling operations of the fan unit.

4. The moisture drying device of claim 3, wherein said switch further comprises a timer to limit the fan unit to operate in a preset amount of time.

5. The moisture drying device of claim 1, the energy source comprises direct current electric power drawn from a wall outlet.

6. The moisture drying device of claim 1, the energy source comprises direct current electric power drawn from an automobile's battery.

7. The moisture drying device of claim 1, the energy source comprises direct current electric power drawn from one or more batteries.

8. The moisture drying device of claim 1, the energy source comprises a power and control unit.

9. The moisture drying device of claim 8, the power and control unit is so dimensioned to be stored within a cavity space of a carrying case of the wind musical instrument.

10. The moisture drying device of claim 8, the power and control unit comprises one or more rechargeable batteries and a switch for controlling the fan unit's operations.

11. The moisture drying device of claim 1, said cable is configured to be released at either end.

12. The moisture drying device of claim 1, said cable is configured to transmit electric power.

13. The moisture drying device of claim 1, the adjustable adapter further contains a clumping means for clamping onto the opening of the wind musical instrument's tubular body.

14. The moisture drying device of claim 1, wherein the adjustable adaptor comprises at least three struts extended radially outward from the fan unit's center in an axisymmetrical manner.

15. The moisture drying device of claim 14, each of the at least three struts comprises a means for adjusting said each strut's length to enable the moisture drying device to be snuggled with the wind musical instrument's inside surface.

16. The moisture drying device of claim 1, the adjustable adapter is a doughnut-shaped structure with inner hole configured for coupling to the perimeter of the enclosure of the fan unit.

17. The moisture drying device of claim 1, wherein the wind musical instrument comprises one of trumpet, saxophone, horn, French horn, cornet, flute, tuba, clarinet, oboe, bassoon, Baritone horn, English horn, flugelhorn and trombone.

* * * * *